US009875832B2

(12) United States Patent
Yamaguchi et al.

(10) Patent No.: US 9,875,832 B2
(45) Date of Patent: Jan. 23, 2018

(54) GRAIN-ORIENTED ELECTRICAL STEEL SHEET

(71) Applicant: JFE STEEL CORPORATION, Tokyo (JP)

(72) Inventors: Hiroi Yamaguchi, Tokyo (JP); Seiji Okabe, Tokyo (JP); Hirotaka Inoue, Tokyo (JP); Ryuichi Suehiro, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 303 days.

(21) Appl. No.: 14/368,654

(22) PCT Filed: Dec. 19, 2012

(86) PCT No.: PCT/JP2012/008121
§ 371 (c)(1),
(2) Date: Jun. 25, 2014

(87) PCT Pub. No.: WO2013/099160
PCT Pub. Date: Jul. 4, 2013

(65) Prior Publication Data

US 2015/0010762 A1 Jan. 8, 2015

(30) Foreign Application Priority Data

Dec. 26, 2011 (JP) ..... 2011-284454

(51) Int. Cl.
*H01F 1/16* (2006.01)
*C21D 8/12* (2006.01)
(Continued)

(52) U.S. Cl.
CPC ..... *H01F 1/16* (2013.01); *C21D 6/008* (2013.01); *C21D 8/12* (2013.01); *C21D 8/1255* (2013.01);
(Continued)

(58) Field of Classification Search
CPC ..... C21D 8/12; C22C 38/00; C23C 22/74; H01F 1/16
(Continued)

(56) References Cited

U.S. PATENT DOCUMENTS 5,411,604 A * 5/1995 Inokuti ..... H01F 41/0233 148/112
6,280,862 B1 8/2001 Inokuti
(Continued)

FOREIGN PATENT DOCUMENTS

EP 1227163 7/2002
EP 2599883 6/2013
(Continued)

OTHER PUBLICATIONS

NPL: English machine translation of JP 2009235471A, Oct. 2009.*
(Continued)

*Primary Examiner* — Jie Yang
(74) *Attorney, Agent, or Firm* — Young & Thompson

(57) ABSTRACT

Provided is a grain-oriented electrical steel sheet, with reduced iron loss by magnetic domain refining treatment, exhibiting an excellent noise property and effectively reducing noise generated when stacked in an iron core of a transformer. In a grain-oriented electrical steel sheet including a forsterite film and a tension coating on both surfaces, magnetic domain refining treatment has been performed to apply linear thermal strain to the grain-oriented electrical steel sheet, the magnitude of deflection in the rolling direction of the steel sheet is 600 mm or more and 6000 mm or less as the curvature radius of the deflected surface with the surface having the strain applied thereto being the inner side, and the magnitude of deflection in the direction orthogonal to the rolling direction is 2000 mm or more as the curvature
(Continued)

radius of the deflected surface with the surface having the strain applied thereto being the inner side.

12 Claims, 4 Drawing Sheets

(51) Int. Cl.

| | |
|---|---|
| ***C22C 38/00*** | (2006.01) |
| ***C22C 38/04*** | (2006.01) |
| ***C22C 38/60*** | (2006.01) |
| ***H01F 1/18*** | (2006.01) |
| ***C22C 38/02*** | (2006.01) |
| ***C22C 38/06*** | (2006.01) |
| ***C22C 38/08*** | (2006.01) |
| ***C22C 38/16*** | (2006.01) |
| ***C23C 22/74*** | (2006.01) |
| ***C21D 6/00*** | (2006.01) |
| ***C21D 9/46*** | (2006.01) |
| ***C21D 10/00*** | (2006.01) |

(52) U.S. Cl.
CPC ..... *C21D 8/1266* (2013.01); *C21D 8/1283* (2013.01); *C21D 8/1288* (2013.01); *C21D 8/1294* (2013.01); *C21D 9/46* (2013.01); *C21D 10/00* (2013.01); *C22C 38/00* (2013.01); *C22C 38/001* (2013.01); *C22C 38/02* (2013.01); *C22C 38/04* (2013.01); *C22C 38/06* (2013.01); *C22C 38/08* (2013.01); *C22C 38/16* (2013.01); *C22C 38/60* (2013.01); *C23C 22/74* (2013.01); *H01F 1/18* (2013.01); *C21D 2201/05* (2013.01); *C21D 2221/00* (2013.01)

(58) Field of Classification Search
USPC ..... 148/306
See application file for complete search history.

(56) References Cited

U.S. PATENT DOCUMENTS

| | | | |
|---|---|---|---|
| 6,602,357 | B2 | 8/2003 | Senda et al. |
| 8,790,471 | B2 | 7/2014 | Sakai et al. |
| 2005/0126659 | A1 | 6/2005 | Homma et al. |
| 2013/0143003 | A1 | 6/2013 | Takenaka et al. |
| 2013/0206283 | A1 | 8/2013 | Inoue et al. |
| 2013/0213525 | A1 | 8/2013 | Shingaki et al. |
| 2014/0234638 | A1 | 8/2014 | Takajo et al. |
| 2014/0360629 | A1 | 12/2014 | Inoue et al. |
| 2015/0010762 | A1 | 1/2015 | Yamaguchi et al. |

FOREIGN PATENT DOCUMENTS

| | | |
|---|---|---|
| EP | 2602342 | 6/2013 |
| JP | 57-2252 | 1/1982 |
| JP | 59-197525 | 11/1984 |
| JP | 04-362139 | 12/1992 |
| JP | 05-43944 | 2/1993 |
| JP | 05-179355 | 7/1993 |
| JP | 06-136449 | 5/1994 |
| JP | 06-72266 | 9/1994 |
| JP | 11-293340 | 10/1999 |
| JP | 2007-090363 | 4/2007 |
| JP | 2009-235471 | 10/2009 |
| JP | 2012-031515 | 2/2012 |
| JP | 2012-052228 | 3/2012 |
| JP | 2012-140665 | 7/2012 |
| WO | 2012-017671 | 2/2012 |

OTHER PUBLICATIONS

International Preliminary Report on Patentability—PCT/JP2012/008121—dated Jul. 1, 2014.
International Search Report, PCT/JP2012/008121, dated Apr. 2, 2013.
Japanese Office Action, JP2013-527811, dated Aug. 13, 2013.
U.S. Office Action for U.S. Appl. No. 14/368,975 dated Jan. 6, 2016.
U.S. Office Action for U.S. Appl. No. 14/368,975 dated May 23, 2016.
Extended European search report, dated Jul. 1, 2015, in corresponding European Patent Application No. 12863643.8.
Korean Office Action, dated Apr. 30, 2015, in corresponding Korean Patent Application No. 10-2014-7018429.

* cited by examiner

How to calculate the curvature radius

GRAIN-ORIENTED ELECTRICAL STEEL SHEET

TECHNICAL FIELD

The present invention relates to a grain-oriented electrical steel sheet utilized for an iron core of a transformer or the like.

BACKGROUND ART

Grain-oriented electrical steel sheets are material mainly used as the iron core of a transformer. From the perspective of achieving high efficiency of a transformer and reducing the noise thereof, a grain-oriented electrical steel sheet is required to have material properties including low iron loss and low magnetic strain.

In this regard, it is important to highly accord secondary recrystallized grains of a steel sheet with (110)[001] orientation, i.e. the "Goss orientation". It is known that if the degree of orientation of the crystal grains is too high, however, the iron loss ends up increasing. Therefore, to solve this problem, a technique has been developed to introduce strain and grooves into the surface of a steel sheet to subdivide the width of a magnetic domain to reduce iron loss, i.e. a magnetic domain refining technique.

For example, JP S57-2252 B2 (PTL 1) proposes a technique of irradiating a steel sheet as a finished product with a laser to introduce linear high-dislocation density regions into a surface layer of the steel sheet, thereby narrowing magnetic domain widths and reducing iron loss of the steel sheet.

Furthermore, JP H6-072266 B2 (PTL 2) proposes a technique for controlling the magnetic domain width by means of electron beam irradiation. By this method of reducing iron loss with electron beam irradiation, electron beam scanning can be performed at a high rate by controlling magnetic fields. Since there is no mechanically movable part as found in an optical scanning mechanism used in laser application, this method is particularly advantageous when irradiating a series of wide strips, each having a width of 1 m or more, continuously and at a high rate to apply strain.

CITATION LIST

Patent Literature

PTL 1: JP S57-2252 B2
PTL 2: JP H6-072266 B2

SUMMARY OF INVENTION

Technical Problem

However, a problem remains in that even a grain-oriented electrical steel sheet that has been subjected to the above-described magnetic domain refining treatment may produce significant transformer noise when assembled into an actual transformer.

The present invention has been developed in view of the above circumstances, and an object thereof is to provide a grain-oriented electrical steel sheet, with reduced iron loss by magnetic domain refining treatment, that exhibits an excellent noise property and can effectively reduce noise generated when used by being stacked in an iron core of a transformer.

Specifically, primary features of the present invention are as follows.

(1) A grain-oriented electrical steel sheet comprising a forsterite film and a tension coating on both surfaces of the steel sheet, wherein magnetic domain refining treatment has been performed to apply linear thermal strain to (a surface of) the grain-oriented electrical steel sheet, a magnitude of deflection in a rolling direction of the steel sheet is 600 mm or more and 6000 mm or less as a curvature radius of a deflected surface with a surface having the thermal strain applied thereto being an inner side, and a magnitude of deflection in a direction orthogonal to the rolling direction is 2000 mm or more as the curvature radius of the deflected surface with the surface having the strain applied thereto being the inner side.

(2) The grain-oriented electrical steel sheet according to (1), wherein before the magnetic domain refining treatment is performed, a combined film tension of the forsterite film and the tension coating is equivalent on both surfaces of the steel sheet, and a magnitude of deflection when the forsterite film and the tension coating are removed from only one of both surfaces of the steel sheet is 500 mm or less as the curvature radius of the deflected surface.

(3) The grain-oriented electrical steel sheet according to (1) or (2), wherein the linear thermal strain is applied by laser beam irradiation.

(4) The grain-oriented electrical steel sheet according to (1) or (2), wherein the linear thermal strain is applied by electron beam irradiation.

When assessing the magnitude of deflection in the rolling direction, the curvature radius as the magnitude of deflection of the above steel sheet is calculated with the following equation after cutting out a sample measuring 300 mm in the rolling direction and 100 mm in the direction orthogonal to the rolling direction from the grain-oriented electrical steel sheet before or after application of thermal strain, and standing the 100 mm side of the sample in the vertical direction to measure the distances x and L as illustrated in FIG. 1.

$$\text{curvature radius } R=(L^2+4x^2)/8x$$

The above equation was derived from the following two relational expressions, in accordance with the illustration in FIG. 2.

$$L=2R\sin(\theta/2)$$

$$x=R(1-\cos(\theta/2))$$

When assessing the magnitude of deflection in the direction orthogonal to the rolling direction, the curvature radius is calculated by cutting out a sample measuring 300 mm in the direction orthogonal to the rolling direction and 100 mm in the rolling direction and performing similar measurements.

When deflection is compared to a bow, the rolling direction and the direction orthogonal to the rolling direction with respect to the deflection refer to the direction in which the bowstring extends.

Advantageous Effect of Invention

According to the present invention, in a transformer produced by stacking grain-oriented electrical steel sheets with reduced iron loss by application of strain, it is possible to reduce noise greatly as compared to a conventional grain-oriented electrical steel sheet.

BRIEF DESCRIPTION OF DRAWINGS

The present invention will be further described below with reference to the accompanying drawings, wherein.

DESCRIPTION OF EMBODIMENTS

Figure 1:
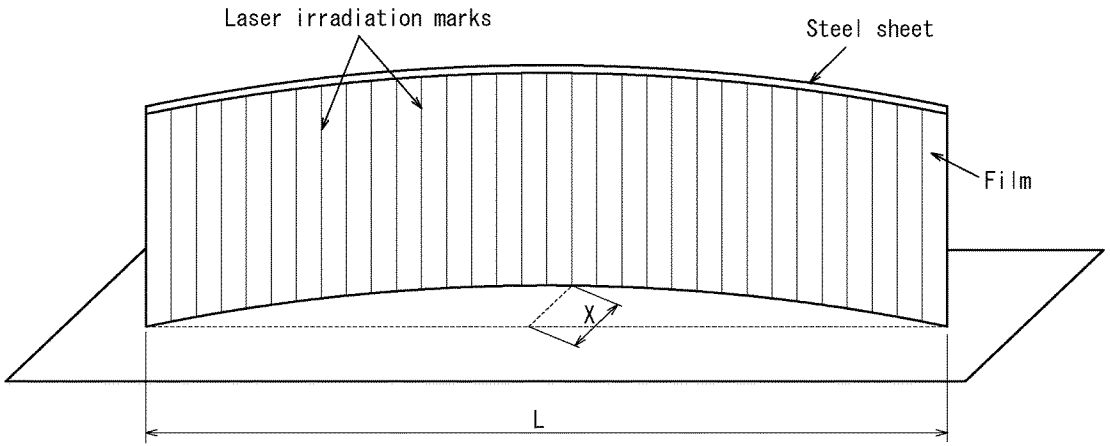
FIG. 1 illustrates how to measure the curvature radius in a steel sheet.

The following describes a grain-oriented electrical steel sheet of the present invention in detail.

A forsterite film and a tension coating are normally formed on the surface of a product grain-oriented electrical steel sheet, and laser irradiation, electron beam irradiation, or the like is applied to the surface of the tension coating in order to reduce iron loss. Iron loss is reduced by irradiation because thermal strain is applied by high-energy beam irradiation on the surface of the steel sheet, subdividing the magnetic domains of the steel sheet.

By introducing local thermal strain periodically on one side of the steel sheet, deflection occurs in the steel sheet in the rolling direction, with a surface having strain applied thereto being the inner side. Although the steel sheet shape including this deflection has nearly no effect on iron loss measurement and magnetic flux density measurement, it has become clear that the steel sheet shape causes problems when assembling a transformer.

Magnetic domain control via thermal strain application is a technique applied to the magnetic domain structure of the wide main magnetic domain in order to reduce iron loss by narrowing the magnetic domain width of the main magnetic domain via application of strain at nearly a right angle. Accordingly, in the location where thermal strain is applied, the magnetic domain structure changes locally, yielding a magnetic domain structure referred to as an auxiliary magnetic domain or a closure domain. Magnetostrictive vibration, the main cause of noise, is a direct reflection of the result of dynamic magnetic domain structure change under alternating current excitation. Therefore, the noise value may increase or decrease depending on the intensity and pattern of the thermal strain application.

The present invention focuses on deflection when viewed in terms of the entire steel sheet, aside from magnetostrictive vibration based on this local magnetic domain structure. In other words, in the stacked structure of the iron core of a transformer, a steel sheet that has deflection in the longitudinal direction (rolling direction) is corrected to be straight and then stacked, yet at this time, tensile stress acts on the surface on which thermal strain was applied, and compressive stress acts on the surface on which thermal strain was not applied.

The inventors therefore manufactured a steel sheet using a continuous laser to control the magnetic domain with irradiation beam intensity and a variety of iterative irradiation pitches. Then, the inventors produced a model iron core of a 500 mm square three-phase three-leg transformer from the steel sheet and closely examined the steel sheet magnitude of deflection and the noise generated by the iron core. The weight of the grain-oriented electrical steel sheet that was used was approximately 20 kg. The inventors applied a load of 98.1 kPa (1.0 kgf/cm$^2$) in terms of contact pressure to the entire surface of the iron core, performed alternating current excitation at a magnetic flux density of 1.7 T and a frequency of 50 Hz, and measured noise.

Noise measurement was performed by taking the average at three points using a capacitor microphone set at a position 200 mm directly above the center of each of the U-leg, V-leg, and W-leg. The inventors also performed frequency analysis, using an overall value to compare noise.

Figure 3:
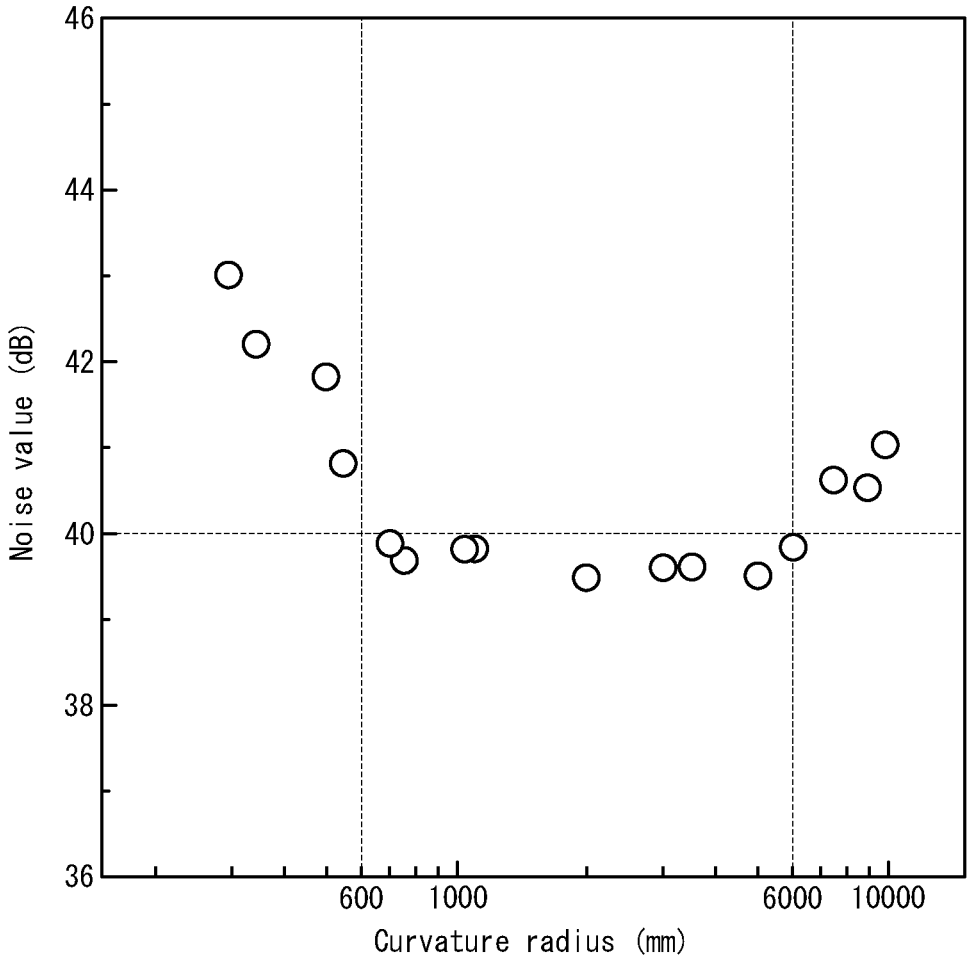
FIG. 3 is a graph showing the relationship between the magnitude of deflection (curvature radius) in the longitudinal direction of the steel sheet and the noise value of the iron core.

The magnitude of deflection in the longitudinal direction (rolling direction) of the steel sheet was measured as the curvature radius, and FIG. 3 shows the results of plotting the magnitude of deflection on the horizontal axis and the noise value of the iron core on the vertical axis. As illustrated in FIG. 3, the noise value increases rapidly when the curvature radius is less than 600 mm. This is considered to be because the shape of a steel sheet with a large magnitude of deflection is corrected at the time of stacking, thereby applying intense stress. It is also clear that when the curvature radius is in a range exceeding 6000 mm, the noise tends to increase. It is inferred that this increase in noise occurs due to the amount of applied thermal strain being too small. In other words, in material subjected to magnetic domain refining treatment by application of thermal strain, the magnetic domain width itself has become narrow due to magnetic domain control. Hence, the vibration amplitude during so-called magnetostrictive vibration decreases, which is advantageous in terms of noise. Accordingly, when considering noise generated in an actual transformer, an optimal range exists for the steel sheet magnitude of deflection, which reflects the amount of applied thermal strain and the application pattern. Namely, the steel sheet magnitude of deflection in the rolling direction is 600 mm or more and 6000 mm or less as a curvature radius, with the surface having the thermal strain applied thereto being the inner side.

During the assembly of an actual large-scale transformer, if the steel sheet has deflection in the longitudinal direction, i.e. the rolling direction, problems will obviously occur during the stacking operation.

Next, the inventors also focused on the magnitude of deflection in the direction orthogonal to the rolling direction. This time, using a continuous laser, the inventors periodically changed the intensity when scanning the irradiation beam and modified the focus itself from precise to slightly out of focus. The beam intensity, the pitch, and the like were adjusted so that the magnitude of deflection in the rolling direction, i.e. the longitudinal direction of the steel sheet, was a constant 5000 mm as the curvature radius. At the same time, pulse oscillation type laser irradiation was also performed. During pulse irradiation, intensity cannot be modified periodically.

Figure 4:
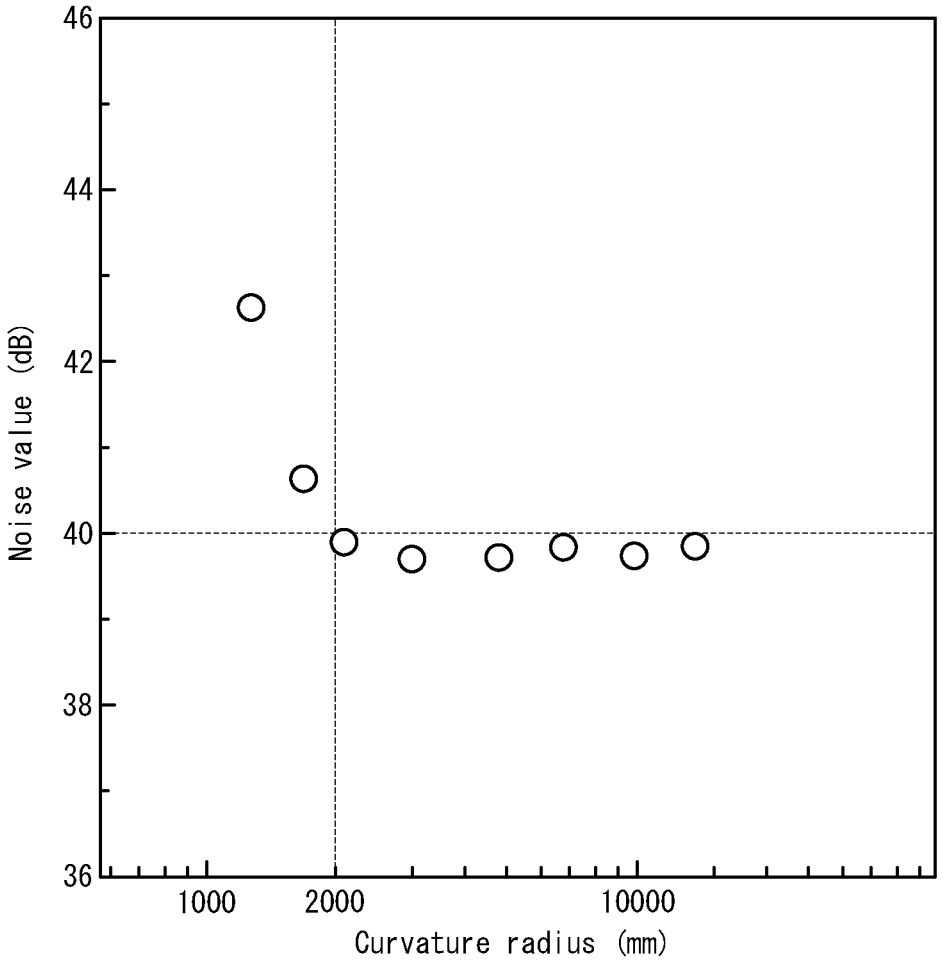
FIG. 4 is a graph showing the relationship between the magnitude of deflection (curvature radius) in the direction orthogonal to the rolling direction of the steel sheet and the noise value of the iron core.

FIG. 4 shows the relationship with noise for the results of measuring the magnitude of deflection, in the direction orthogonal to the rolling direction, as the curvature radius. Noise increases in a region in which the magnitude of deflection of the steel sheet, in the direction orthogonal to the rolling direction, is less than 2000 mm as the curvature radius, with the surface having the thermal strain applied thereto being the inner side. Accordingly, it is considered that a smaller value for the deflection in the direction orthogonal to the rolling direction is better with respect to noise. Note that it is not particularly necessary to set an upper limit, and the steel sheet may be perfectly flat in the direction orthogonal to the rolling direction.

Furthermore, an appropriate film tension of the forsterite film and the tension coating is useful for noise control. As the method for assessing the film tension for the combination of the forsterite film and the tension coating, the curvature radius when the forsterite film and the tension coating are removed from only one of both surfaces of the steel sheet before application of thermal strain may be used. In this case, the curvature radius needs to be 500 mm or less to control the magnetostrictive vibration of the steel sheet. If the curvature radius is larger, the combined film tension becomes too small, and the effect of controlling the magnetostrictive vibration of the steel sheet reduces. As a result, noise ends up increasing.

Next, the conditions for manufacturing a grain-oriented electrical steel sheet according to the present invention are described concretely.

In the present invention, the chemical composition of the slab for a grain-oriented electrical steel sheet is not particularly limited, as long as it is a chemical composition for which secondary recrystallization occurs.

In the case of using an inhibitor, the chemical composition may contain appropriate amounts of Al and N when using, for example, an AlN-based inhibitor, or appropriate amounts of Mn and Se and/or S when using an MnS.MnSe-based inhibitor. Of course, both inhibitors may also be used in combination. In this case, preferred contents of Al, N, S and Se are: Al: 0.01 mass % to 0.065 mass %, N: 0.005 mass % to 0.012 mass %, S: 0.005 mass % to 0.03 mass %, and Se: 0.005 mass % to 0.03 mass %, respectively.

Furthermore, the present invention is also applicable to a grain-oriented electrical steel sheet having limited contents of Al, N, S and Se without using an inhibitor.

In this case, the contents of Al, N, S and Se are preferably limited to Al: 100 mass ppm or less, N: 50 mass ppm or less, S: 50 mass ppm or less, and Se: 50 mass ppm or less, respectively.

Concretely, the basic components and optional added components in the slab for a grain-oriented electrical steel sheet of the present invention are as follows.

C: 0.08 Mass % or Less

Carbon (C) is added to improve the texture of a hot-rolled steel sheet. If the C content exceeds 0.08 mass %, however, it becomes difficult to reduce the C content to 50 mass ppm or less, at which point magnetic aging will not occur during the manufacturing process. Therefore, the C content is preferably 0.08 mass % or less. It is not particularly necessary to set a lower limit on the C content, because secondary recrystallization is enabled by a material not containing C.

Si: 2.0 Mass % to 8.0 Mass %

Silicon (Si) is an element that is effective for enhancing electrical resistance of steel and improving iron loss properties thereof. If the content is less than 2.0 mass %, however, a sufficient iron loss reduction effect cannot be achieved. On the other hand, a content exceeding 8.0 mass % significantly deteriorates formability and also decreases the magnetic flux density of the steel. Therefore, the Si content is preferably in a range of 2.0 mass % to 8.0 mass %.

Mn: 0.005 Mass % to 1.0 Mass %

Manganese (Mn) is a necessary element for improving hot workability of steel. However, this effect is inadequate when the Mn content in steel is below 0.005 mass %. On the other hand, Mn content in steel above 1.0 mass % deteriorates magnetic flux density of a product steel sheet. Accordingly, the Mn content is preferably in a range of 0.005 mass % to 1.0 mass %.

Furthermore, in addition to the above basic components, the following elements may also be included as deemed appropriate for improving magnetic properties.

At least one element selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, and Mo: 0.005 mass % to 0.10 mass %

Nickel (Ni) is an element that is useful for improving the texture of a hot-rolled steel sheet for better magnetic properties thereof. However, Ni content in steel below 0.03 mass % is less effective for improving magnetic properties, while Ni content in steel above 1.5 mass % makes secondary recrystallization of the steel unstable, thereby deteriorating the magnetic properties thereof. Thus, Ni content is preferably in a range of 0.03 mass % to 1.5 mass %.

In addition, tin (Sn), antimony (Sb), copper (Cu), phosphorus (P), and molybdenum (Mo) are useful elements in terms of improving magnetic properties of steel. However, each of these elements becomes less effective for improving magnetic properties of the steel when contained in steel in an amount less than the aforementioned lower limit and inhibits the growth of secondary recrystallized grains of the steel when contained in an amount exceeding the aforementioned upper limit. Thus, each of these elements is preferably contained within the respective ranges thereof specified above.

The balance other than the above-described elements is Fe and incidental impurities that are incorporated during the manufacturing process.

A slab having the above-described chemical composition may then be heated by a normal method and hot-rolled or directly subjected to hot rolling after casting without being heated. A thin slab or thinner cast steel may be either hot rolled or directly used in the next process by omitting hot rolling.

Furthermore, hot band annealing is performed as necessary. At this time, in order to highly develop the Goss texture in the product steel sheet, the hot band annealing temperature is preferably in a range of 800° C. to 1100° C. If the hot band annealing temperature is less than 800° C., the band structure during hot rolling remains, thereby making it difficult to achieve a primary recrystallization texture with uniformly-sized grains and impeding the progress of secondary recrystallization. On the other hand, if the hot band annealing temperature exceeds 1100° C., the grains become excessively coarse after hot band annealing, thereby making it extremely difficult to achieve a primary recrystallization texture with uniformly-sized grains.

After performing hot band annealing, the material is formed as a cold rolled sheet by cold rolling once, or two or more times with intermediate annealing therebetween. Subsequently, after recrystallization annealing, an annealing separator is applied. The steel sheet with the annealing separator applied thereto is then subjected to final annealing for the purpose of secondary recrystallization and formation of a forsterite film.

After the final annealing, it is effective to correct the shape of the steel sheet by performing flattening annealing. When steel sheets are to be stacked for use, providing a tension coating on the surface of each steel sheet either before or after the flattening annealing is effective in improving iron loss properties. This tension coating is generally a phosphate-colloidal silica based glass coating, yet an oxide having a low coefficient of thermal expansion, such as an alumina borate based oxide, is also suitable. A carbide, nitride, or the like with a large Young's modulus is also effective as a coating yielding even higher tension.

When applying the tension coating, it is crucial to adjust the application amount and baking conditions to sufficiently bring out the tension.

In the grain-oriented electrical steel sheet before magnetic domain refining treatment, in order for the combined film tension of the forsterite film and the tension coating to be equivalent on both surfaces of the steel sheet, and for the magnitude of deflection when the forsterite film and the tension coating are removed from only one of both surfaces of the steel sheet to be 500 mm or less as the curvature radius of the deflected surface, it is important that the flattening annealing be performed at an appropriate tension and an appropriate temperature. Furthermore, with regard to the coating, it is important that a glass coating having a low coefficient of thermal expansion be sufficiently baked, and that tensile stress based on thermal residual stress be sufficiently generated.

In the present invention, after application of tension coating, magnetic domain refining is performed by irradiating the surface of the steel sheet with a thermal beam, such as a laser, electron beam, or the like. The direction of the irradiation marks is preferably from 90° to 45° with respect to the rolling direction of the steel sheet.

In a grain-oriented electrical steel sheet to which magnetic domain refining treatment has been applied, in order for the magnitude of deflection in the rolling direction of the steel sheet to be 600 mm or more and 6000 mm or less as the curvature radius of the deflected surface with the surface having the thermal strain applied thereto being the inner side, and for the magnitude of deflection in a direction orthogonal to the rolling direction to be 2000 mm or more as the curvature radius of the deflected surface with the surface having the strain applied thereto being the inner side, it is effective to combine methods such as adjusting the beam intensity of the laser or electron beam and the beam profile and varying the intensity distribution during scanning. Also, in order to satisfy the above ranges, it is crucial to combine the above methods under optimal conditions. In particular, to adjust the beam profile, it is effective not to always adopt a precise focus, but rather to adjust the focus for a laser and to change the beam focus amount with the focus coil for an electron beam.

EXAMPLE 1

A steel slab including Si: 3.2 mass %, C: 0.07 mass %, Mn: 0.06 mass %, Ni: 0.05 mass %, Al: 0.027 mass %, N: 0.008 mass %, and Se: 0.02 mass %, and the balance as Fe and incidental impurities was heated to 1450° C. and then hot-rolled to obtain a hot-rolled steel sheet with a thickness of 1.8 mm. Two cold-rolling operations were performed on the hot-rolled steel sheet with intermediate annealing therebetween to obtain a cold-rolled sheet for a grain-oriented electrical steel sheet having a final sheet thickness of 0.23 mm. The cold-rolled sheet was then decarburized, and after primary recrystallization annealing, an annealing separator containing MgO as the primary component was applied, and final annealing including a secondary recrystallization process and a purification process was performed to yield a grain-oriented electrical steel sheet with a forsterite film. An insulating coating containing 60% colloidal silica and aluminum phosphate was then applied to the steel sheet, which was baked at 800° C. At this time, two standards for the coating weight were used: a thick weight (dry coating weight per side of 6.5 g/m$^2$) and a thin weight (dry coating weight per side of 4.0 g/m$^2$).

Figure 2:
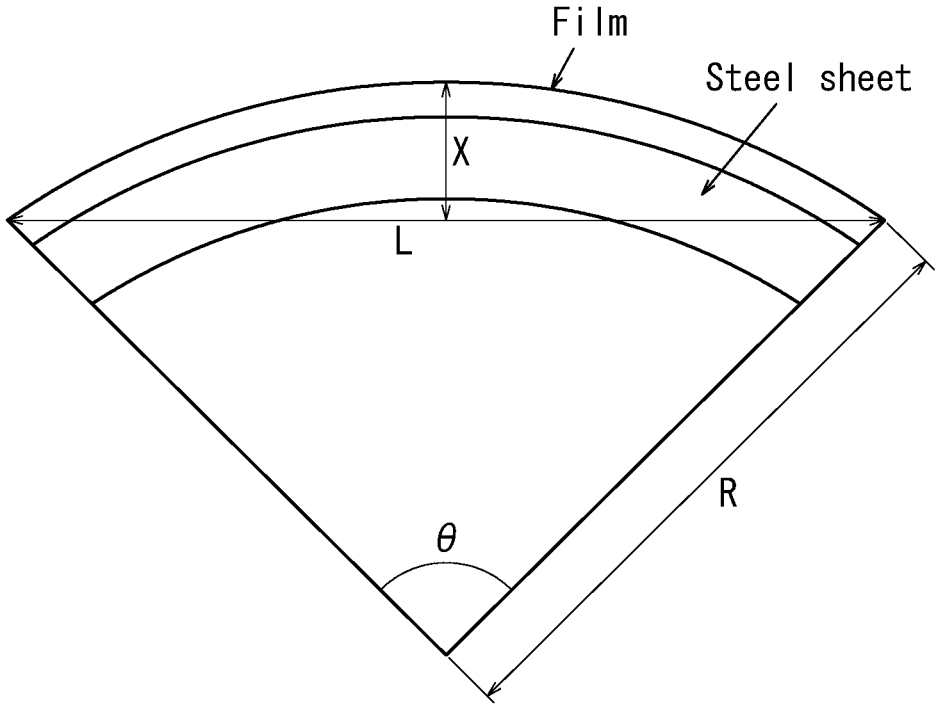
FIG. 2 illustrates the process for deriving the formula for calculating the curvature radius.

The resulting sample was sheared in the rolling direction and the direction orthogonal to the rolling direction to produce 300 mm long by 100 mm wide test pieces for film tension assessment. Subsequently, the forsterite film and insulating coating were removed from only one surface of the test pieces in hot hydrochloric acid, and the curvature radius in the rolling direction was measured. Note that the curvature radius was calculated in accordance with the above description of FIG. 2. The same holds for the curvature radius below as well.

Next, magnetic domain refining treatment was performed on the grain-oriented electrical steel sheets by irradiation with a continuous fiber laser in a direction orthogonal to the rolling direction. The laser beam was scanned over the steel sheets using a galvanometer scanner.

During laser irradiation, the interval in the rolling direction between irradiation rows was kept constant at 4 mm, whereas the intensity of the continuous laser was not a constant condition. Rather, deflection was adjusted through irradiation by varying the intensity during scanning in a range of 50% to 100% and changing the focus from a precise position to a slightly out of focus position.

A portion of the obtained samples was sheared in the rolling direction and the direction orthogonal to the rolling direction to a size of 300 mm long by 100 mm wide, and the curvature of the steel sheets after laser irradiation was measured in the rolling direction and in the direction orthogonal to the rolling direction. The remainder of the samples were sheared into bevel-edged pieces for a 500 mm square three-leg iron core and stacked to produce an approximately 40 kg three-phase transformer. The width of each leg was 100 mm. Using a capacitor microphone, the noise at 1.7 T and 50 Hz excitation was measured and the average value calculated at a position 20 cm directly above each leg of the iron core for the three-phase transformer. At this time, A-scale weighting was performed as frequency weighting.

Table 1 lists the measured transformer noise, along with the curvature radius in the rolling direction and the direction orthogonal to the rolling direction of the steel sheet, and the curvature radius, upon removal from one surface, that serves as an index for the film tension. For samples 1, 4 to 6, 9, 10, and 12, for which the curvature in the rolling direction or the direction orthogonal to the rolling direction is not within the appropriate range, the noise of the model iron core for a transformer increased. By contrast, noise was suppressed in samples 2, 3, 7, 8, and 11, which satisfied the conditions of the present invention, with noise being suppressed even further in samples 2, 3, 7, and 11, for which the film tension was in the preferred range of the present invention.

TABLE 1

| No. | Curvature radius in rolling direction (mm) | Curvature radius in direction orthogonal to rolling direction (mm) | Curvature radius of film tension (mm) | Noise of model iron core (dBA) | Notes |
|---|---|---|---|---|---|
| 1 | 400 | 3000 | 395 | 47.6 | Comparative example |
| 2 | 2500 | 2800 | 390 | 45.6 | Inventive example |

TABLE 1-continued

| No. | Curvature radius in rolling direction (mm) | Curvature radius in direction orthogonal to rolling direction (mm) | Curvature radius of film tension (mm) | Noise of model iron core (dBA) | Notes |
|---|---|---|---|---|---|
| 3 | 5500 | 3200 | 390 | 45.4 | Inventive example |
| 4 | 9000 | 3000 | 400 | 47.2 | Comparative example |
| 5 | 5000 | 1000 | 385 | 48.0 | Comparative example |
| 6 | 500 | 1500 | 390 | 48.0 | Comparative example |
| 7 | 4500 | 3500 | 385 | 45.2 | Inventive example |
| 8 | 4000 | 3000 | 640 | 46.6 | Inventive example |
| 9 | 8500 | 3200 | 650 | 49.0 | Comparative example |
| 10 | 5000 | 1800 | 640 | 49.0 | Comparative example |
| 11 | 600 | 2000 | 500 | 45.8 | Inventive example |
| 12 | 6500 | 300 | 400 | 47.0 | Comparative example |

EXAMPLE 2

A steel slab including Si: 3.3 mass %, C: 0.06 mass %, Mn: 0.08 mass %, S: 0.023 mass %, Al: 0.03 mass %, N: 0.007 mass %, Cu: 0.2 mass %, and Sb: 0.02 mass %, and the balance as Fe and incidental impurities was heated to 1430° C. and then hot-rolled to obtain a hot-rolled steel sheet with a thickness of 2.5 mm. Two cold-rolling operations were performed on the hot-rolled steel sheet with intermediate annealing therebetween to obtain a cold-rolled sheet for a grain-oriented electrical steel sheet having a final sheet thickness of 0.23 mm. The cold-rolled sheet was then decarburized, and after primary recrystallization annealing, an annealing separator containing MgO as the primary component was applied, and final annealing including a secondary recrystallization process and a purification process was performed to yield a grain-oriented electrical steel sheet with a forsterite film. An insulating coating containing 50% colloidal silica and magnesium phosphate was then applied to the steel sheet, which was baked at 850° C. At this time, two standards for the coating weight were used: a thick weight and a thin weight. The resulting sample was sheared in the rolling direction and the direction orthogonal to the rolling direction to yield 300 mm long by 100 mm wide test pieces for film tension assessment. Subsequently, the forsterite film and insulating coating were removed from only one surface of the steel sheets in hot hydrochloric acid, and the curvature in the rolling direction was measured.

Next, magnetic domain refining treatment was performed on the grain-oriented electrical steel sheets by irradiation with an electron beam in a direction orthogonal to the rolling direction. The degree of vacuum during treatment was 0.5 Pa, and scanning of the electron beam on the steel sheets was performed with a deflection coil.

During electron beam irradiation, the interval in the rolling direction between irradiation rows was kept constant at 5 mm. The steel sheets were not irradiated continuously but rather in a dot pattern, and the interval between dotted lines was varied in a range of 0.1 mm to 1.0 mm. The profile of the beam intensity was varied by adjusting the beam current and the current amount of the focus coil.

A portion of the obtained samples was sheared in the rolling direction and the direction orthogonal to the rolling direction to a size of 300 mm long by 100 mm wide, and the curvature of the steel sheet after electron beam irradiation was measured in the rolling direction and in the direction orthogonal to the rolling direction. The remainder of the samples were sheared into bevel-edged pieces for a 500 mm square three-leg iron core and stacked to produce an approximately 32 kg single-phase transformer. The leg width was 100 mm. Using a capacitor microphone, the noise at 1.7 T and 50 Hz excitation was measured and the average value calculated at a position 20 cm directly above both leg edges of the iron core for the single-phase transformer. At this time, A-scale weighting was performed as frequency weighting.

Table 2 lists the measured transformer noise, along with the curvature radius in the rolling direction and the direction orthogonal to the rolling direction of the steel sheet, and the curvature radius, upon removal from one surface, that serves as an index for the film tension. For samples 1, 2, 5, 6, 9, 10, and 12, for which the curvature in the rolling direction or the direction orthogonal to the rolling direction is not within the appropriate range, the noise of the model iron core for a transformer increased. By contrast, noise was suppressed in samples 3, 4, 7, 8, and 11, which satisfied the conditions of the present invention, with noise being suppressed even further in samples 3, 4, 7, and 11, for which the film tension was in the preferred range of the present invention.

TABLE 2

| No. | Curvature radius in rolling direction (mm) | Curvature radius in direction orthogonal to rolling direction (mm) | Curvature radius of film tension (mm) | Noise of model iron core (dBA) | Notes |
|---|---|---|---|---|---|
| 1 | 400 | 1500 | 365 | 37.6 | Comparative example |
| 2 | 500 | 2500 | 350 | 37.0 | Comparative example |
| 3 | 3000 | 3000 | 350 | 35.4 | Inventive example |
| 4 | 5500 | 3200 | 360 | 35.2 | Inventive example |
| 5 | 8000 | 4000 | 355 | 37.0 | Comparative example |
| 6 | 4000 | 1000 | 350 | 37.4 | Comparative example |
| 7 | 5000 | 2500 | 355 | 35.2 | Inventive example |
| 8 | 4500 | 2200 | 600 | 36.4 | Inventive example |
| 9 | 2500 | 1800 | 590 | 37.8 | Comparative example |
| 10 | 9500 | 2800 | 590 | 38.2 | Comparative example |
| 11 | 600 | 2000 | 500 | 35.6 | Inventive example |
| 12 | 6500 | 2500 | 350 | 37.2 | Comparative example |

The invention claimed is:

1. A grain-oriented electrical steel sheet comprising:

a forsterite film; and a tension coating on both surfaces of the steel sheet, wherein magnetic domain refining treatment has been performed to apply linear thermal strain to the grain-oriented electrical steel sheet, a magnitude of deflection in a rolling direction of the steel sheet is 600 mm or more and 6000 mm or less as a curvature radius of a deflected surface with a surface having the thermal strain applied thereto being an inner side, a magnitude of deflection in a direction orthogonal to the rolling direction is 2000 mm or more as the curvature radius of the deflected surface with the surface having the strain applied thereto being the inner side, and the grain-oriented electrical steel sheet is a final product.

2. The grain-oriented electrical steel sheet according to claim 1, wherein before the magnetic domain refining treatment is performed, a combined film tension of the forsterite film and the tension coating is equivalent on both surfaces of the steel sheet, and a magnitude of deflection when the forsterite film and the tension coating are removed from only one of both surfaces of the steel sheet is 500 mm or less as the curvature radius of the deflected surface.

3. The grain-oriented electrical steel sheet according to claim 1, wherein the linear thermal strain is applied by laser beam irradiation.

4. The grain-oriented electrical steel sheet according to claim 1, wherein the linear thermal strain is applied by electron beam irradiation.

5. The grain-oriented electrical steel sheet according to claim 2, wherein the linear thermal strain is applied by laser beam irradiation.

6. The grain-oriented electrical steel sheet according to claim 2, wherein the linear thermal strain is applied by electron beam irradiation.

7. The grain-oriented electrical steel sheet according to claim 1, wherein the magnitude of deflection in a rolling direction of the steel sheet is 5000 mm.

8. The grain-oriented electrical steel sheet according to claim 1, wherein an inhibitor is used.

9. The grain-oriented electrical steel sheet according to claim 8, wherein the inhibitor is AlN or an MnS·MnSe inhibitor.

10. The grain-oriented electrical steel sheet according to claim 8, wherein the inhibitor is Al: 0.01 mass % to 0.065 mass %, N: 0.005 mass % to 0.012 mass %, S: 0.005 mass % to 0.03 mass %, and Se: 0.005 mass % to 0.03 mass %.

11. The grain-oriented electrical steel sheet according to claim 1, wherein components of the grain-oriented steel sheet include: C: 0.08 mass % or less, Si: 2.0 mass % to 8.0 mass %, Mn: 0.005 mass % to 1.0 mass % and at least one element selected from the group consisting of Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, and Mo: 0.005 mass % to 0.10 mass %, with a balance being Fe and incidental impurities.

12. A core of a transformer, comprising:

the grain-oriented electrical steel sheet of claim 1.

* * * * *